US012492044B2

(12) United States Patent
Wang

(10) Patent No.: US 12,492,044 B2
(45) Date of Patent: Dec. 9, 2025

(54) EASY-TO-FILL CHILD RESISTANT BAG

(71) Applicant: GUANG DONG ASUWANT PACKAGING CO., LTD, Guangdong (CN)

(72) Inventor: Peng Wang, Guangdong (CN)

(73) Assignee: Guang Dong Asuwant Packaging Co., Ltd, Jiangmen (CN)

( * ) Notice: Subject to any disclaimer, the term of this patent is extended or adjusted under 35 U.S.C. 154(b) by 56 days.

(21) Appl. No.: 18/424,860

(22) Filed: Jan. 28, 2024

(65) Prior Publication Data

US 2024/0228122 A1 Jul. 11, 2024

(30) Foreign Application Priority Data

Dec. 18, 2023 (CN) ..... 202311738385.7

(51) Int. Cl.
*B65D 33/34* (2006.01)
*B65D 33/24* (2006.01)

(52) U.S. Cl.
CPC ..... *B65D 33/34* (2013.01); *B65D 33/243* (2013.01); *B65D 2215/00* (2013.01)

(58) Field of Classification Search
CPC ... B65D 33/34; B65D 33/243; B65D 2215/00
USPC ..... 383/5, 63, 66, 203
See application file for complete search history.

(56) References Cited

U.S. PATENT DOCUMENTS 6,659,643 B2 * 12/2003 Plourde ..... B65D 33/2533 383/203
10,513,372 B2 * 12/2019 Wang ..... B65D 33/2508
2006/0210202 A1 * 9/2006 Plourde ..... B65B 61/188 383/203
2022/0274748 A1 * 9/2022 Steele ..... B65D 33/2566

FOREIGN PATENT DOCUMENTS

CN 204137512 U * 2/2015 ..... B65D 33/25
JP 2011042398 A * 3/2011
JP 2014114035 A * 6/2014
WO WO-2016016058 A2 * 2/2016 ..... B65D 33/2525
WO WO-2021211447 A1 * 10/2021 ..... B65D 33/007

OTHER PUBLICATIONS

Machine translation of JP-2014114035-A. (Year: 2014).*

* cited by examiner

*Primary Examiner* — Jes F Pascua

(57) ABSTRACT

A child resistant bag includes: a bag body formed by a front film and a back film adhered together; wherein a tear strip is provided on the front film; a sealing device with a child resistant function is provided on an internal face of the bag body, which comprises a first protective sheet adhering to an upper side or a lower side of the opening and a patch covering the first protective sheet; at least one pair of strip fasteners is correspondingly provided on the patch and an internal face of the front film; the first protective sheet covers the opening and extends to an adhering position of the patch. The strip fasteners on the bag body are covered by the patch, which facilitates the filling of the child resistant bag, thereby improving the filling efficiency.

1 Claim, 11 Drawing Sheets

EASY-TO-FILL CHILD RESISTANT BAG

CROSS REFERENCE OF RELATED APPLICATION

The present invention claims priority under 35 U.S.C. 119(a-d) to CN 202311738385.7, filed Dec. 18, 2023.

BACKGROUND OF THE PRESENT INVENTION

Field of Invention

The present invention relates to child resistant bags, and more particularly to an easy-to-fill child resistant bag.

Description of Related Arts

Zipper bags are used as a convenient product for daily containing of items, such as for holding food and medicine. A zipper bag includes a bag body for containing and a zipper structure for closing and opening the bag body, which is preferred by the majority of consumers due to its convenience in use. However, an ordinary zipper bag can be easily opened by a child. If the bag is filled with medicines or other items that can harm the child, it can be dangerous or cause injury due to accidentally ingesting.

Chinese patent application CN202320648070.2 disclosed a zipper bag which prevents children from opening, comprising a bag body, and a first zipper part and a second zipper part which are fixedly connected to the inner walls of the front and back sides of the bag body, respectively. The first zipper part and the second zipper part are connected in a snap-fit and detachable manner. The bottom of the first zipper part is fixedly connected to the front inner wall of the bag body, and the bottom of the second zipper part is fixedly connected to the rear inner wall of the bag body. The upper ends of the first zipper part and the second zipper part are respectively in contact with the inner wall of the bag body. The top of the second zipper part is fixedly connected to a movable part, and the upper end of the movable part is fixedly connected to the front inner wall of the bag body.

For the sake of aesthetics, zipper of a common zipper bag is set at the interior of the bag body opening. During the filling of some large granules of object, the zipper may interfere the object, resulting in block of the opening, and affecting the filling rate.

SUMMARY OF THE PRESENT INVENTION

An object of the present invention is to solve that conventional zipper bag may cause interference during filling due to the setting of its zipper, which affects the filling rate.

Accordingly, in order to accomplish the above object, the present invention provides:

an easy-to-fill child resistant bag, comprising: a bag body formed by a front film and a back film, wherein edges of the front film are adhered to edges of the back film; a tear strip is provided on the front film and configured to form an opening on the front film; a sealing device with a child resistant function is provided on an internal face of the bag body corresponding to the opening, and the sealing device comprises a first protective sheet adhering to an upper side or a lower side of the opening and extending to the other side, and a patch covering the first protective sheet and adhering to the side opposite to an adhering position of the first protective sheet; at least one pair of strip fasteners is correspondingly provided on the patch and an internal face of the front film; the first protective sheet covers the opening and extends to an adhering position of the patch. If the first protective sheet is adhered to the upper side of the opening, then the first protective sheet extends downwards, and the patch is adhered to the lower side of the opening. If the first protective sheet is adhered to the lower side of the opening, then the first protective sheet extends upwards, and the patch is adhered to the upper side of the opening.

Preferably, the tear strip is integrally molded with the front film or adhered to the internal face of the front film. The tear strip can be flexibly placed and selected according to the actual needs, which is conducive to cost saving and production efficiency.

Preferably, a hand-held portion is provided at one end of the tear strip. The hand-held portion enables the user to remove the tear strip more easily, providing convenience for the user.

Preferably, a second protective sheet is adhered to the patch, and the second protective sheet is adhered near the strip fasteners. The second protective sheet is provided so that the user can easily separate the strip fasteners by pulling the first protective sheet and the second protective sheet, providing convenience for the user.

The present invention also provides an easy-to-fill child resistant bag, comprising: a bag body formed by a front film and a back film, wherein edges of the front film are adhered to edges of the back film; a tear strip is provided on the front film and configured to form an opening on the front film; a sealing device with a child resistant function is provided on an internal face of the bag body corresponding to the opening, and the sealing device comprises a connecting piece adhering to an upper side or a lower side of the opening, and a patch adhering to a side opposite to an adhering position of the connecting piece; at least one pair of strip fasteners is provided between the patch and the connecting piece; a first protective sheet is provided on the connecting piece, and the first protective sheet covers the opening and extends to an adhering position of the patch. The connecting piece at the opening is capable of reinforcing the opening and improving the product stability. At the same time, the installation of the strip fasteners and the first protective sheet on the connecting piece is capable of increasing the efficiency of production and processing. Specifically, if the connecting piece is adhered to the upper side of the opening, then the patch is adhered to the lower side of the opening, and the first protective sheet correspondingly extends downwards. If the connecting piece is adhered to the lower side of the opening, then the patch is adhered to the upper side of the opening, and the first protective sheet correspondingly extends upwards.

Preferably, the tear strip is integrally molded with the front film or adhered to the internal face of the front film. The tear strip can be flexibly placed and selected according to the actual needs, which is conducive to cost saving and production efficiency.

Preferably, a hand-held portion is provided at one end of the tear strip. The hand-held portion enables the user to remove the tear strip more easily, providing convenience for the user.

Preferably, the first protective sheet is integrally molded with or adhered to the connecting piece. The different connection methods of the first protective sheet can be flexibly selected in the process production, which is conducive to improving the production efficiency and reducing the cost.

Preferably, a second protective sheet is adhered to the patch, and the second protective sheet is adhered near the strip fasteners. The second protective sheet is provided so that the user can easily separate the strip fasteners by pulling the first protective sheet and the second protective sheet, providing convenience for the user.

The present invention has the following beneficial effects:

I. The opening is arranged at a side face of the bag body, and the strip fasteners on the internal face of the bag body are covered by the patch. As a result, the strip fasteners will not cause interference when filling the bag, accelerating the filling and improving the production efficiency.

II. The first protective sheet is used to cover the opening, so as to prevent children from unintentionally opening the strip fasteners, thereby providing a certain protection for children and reducing the occurrence of accidents. Meanwhile, an adult can open the by just pulling the first protective sheet, which is convenient.

III. The device only needs to be processed on the front film or the back film, and the processed film can be directly attached with another piece of film. For a bag, only one of the films needs to be processed, which can improve the production efficiency as well as reduce the defective rate.

IV. Because the device only needs to process one piece of film, most of the work can be done before the front film and back film are adhered together, which is conducive to automated processing. During processing, the front film and the back film can be unfolded for processing, which is more convenient.

BRIEF DESCRIPTION OF THE DRAWINGS

In order to illustrate the technical solutions in embodiments of the present invention or prior art more clearly, the accompanying drawings to be used in the description of the embodiments or prior art will be briefly introduced below. It is obvious that the accompanying drawings described below are only some of the embodiments of the present invention, and that other drawings can be obtained according to the structures illustrated in the drawings by a person of ordinary skill in the field, without creative works.

DETAILED DESCRIPTION OF THE PREFERRED EMBODIMENT

Figure 1:
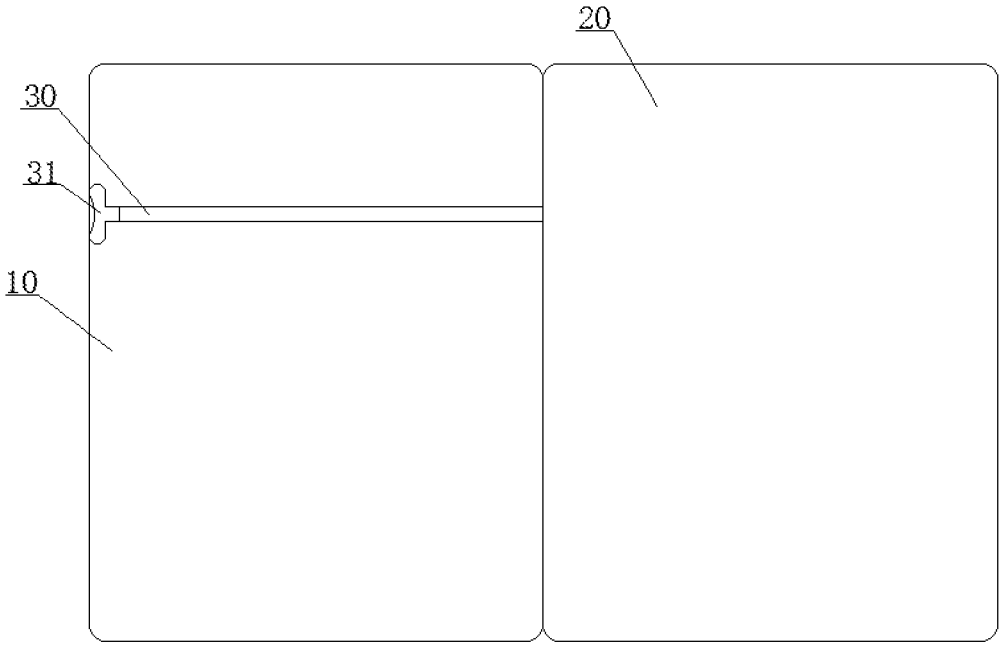
FIG. 1 is a sketch view of unfolded front and back films according to an embodiment.
Figure 2:
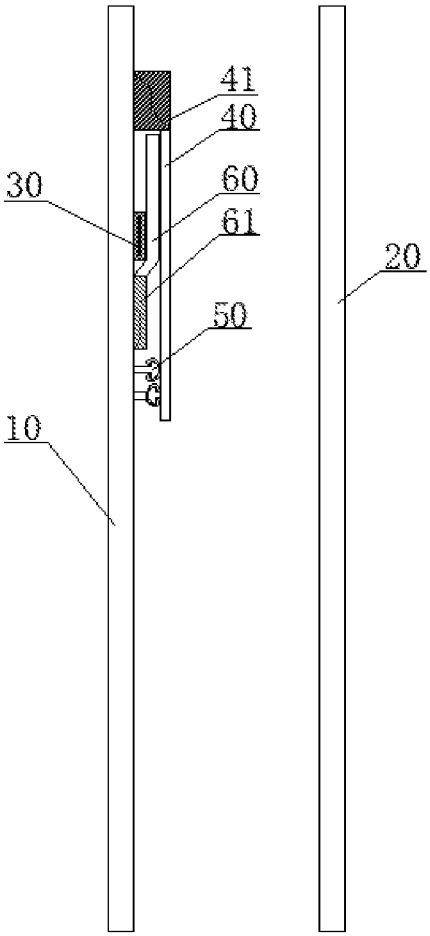
FIG. 2 is a sketch view of a first structure without a connecting piece.
Figure 3:
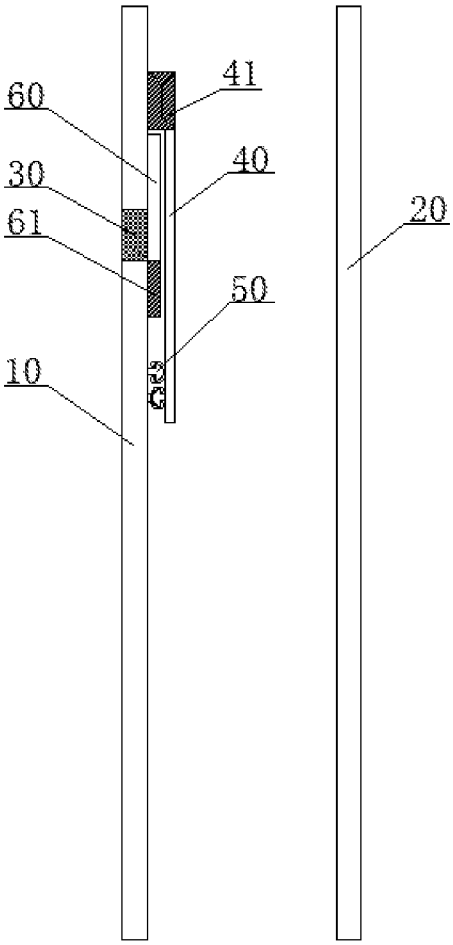
FIG. 3 is a sketch view of a second structure without the connecting piece.
Figure 4:
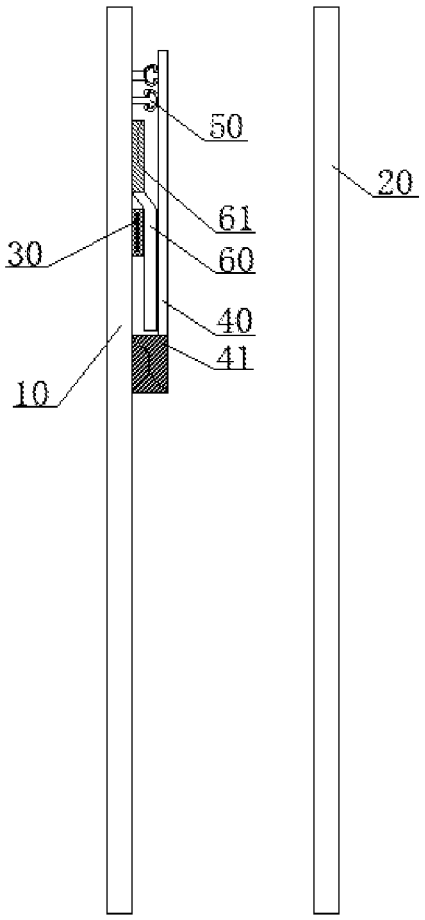
FIG. 4 is a sketch view of a third structure without the connecting piece.

To facilitate understanding, the present invention will be described below in conjunction with embodiments and accompanying drawings.

It should be noted that all directional indications in the embodiments of the present invention are only used to explain the relative positional relationship, movement, etc., between the components in a particular attitude, and that the directional indications change accordingly if that particular attitude is changed.

Furthermore, descriptions such as "first", "second", etc. in the present invention are used for descriptive purposes only and are not to be construed as indicating or implying their relative importance or implicitly specifying the number of technical features indicated. Thus, a feature defined as "first" or "second" may include at least one such feature, either explicitly or implicitly. In the description of the present invention, "plurality" means at least two, e.g., two, three, etc., unless otherwise expressly and specifically limited.

In the present invention, unless otherwise expressly specified and limited, the terms "connect", "mount", etc. are to be understood in a broad sense, e.g. "mount" can be a fixed connection, a removable connection or an integrated connection; it can be a mechanical connection or an electrical connection; it can be a direct connection or an indirect connection through an intermediate medium; it can be a connection within two elements or an interaction between two elements. For those of ordinary skill in the art, the specific meanings of the above terms in the present invention may be understood on a case-by-case basis.

The present invention provides an easy-to-fill child resistant bag, as shown in FIGS. 1-5, comprising: a front film 10 and a back film 20, wherein edges of the front film 10 are adhered to edges of the back film 20 to form a bag body. Before the filling of the child resistant bag, it is possible to adhere only three edges of the front film 10 and the back film 20. According to the embodiment, two opposing side edges and bottom edges are adhered together, and top edges are separated. The bag can be filled through the opening formed by the top edges. The top edges will be adhered together after the filling to complete packaging and sealing.

To facilitate subsequent users to take items from the bag, a tear strip 30 can be provided on the front film 10 or the back film 20, which depends on actual needs. According to the embodiment, the tear strip 30 is provided on the front film 10, which can be tore off to form an opening 80 on the front film 10. The items can be taken from the bag through the opening 80.

Specifically, according to the embodiment, a first protective sheet 60 is adhered to an internal face of the front film 10, (if the opening is arranged on the back film 20, the first protective sheet 60 is adhered to an internal face of the back film 20), wherein the first protective sheet 60 covers the tear strip 30; one end of the first protective sheet 60 is adhered to one side of the opening 80 and extends towards the other side of the opening 80. Specifically, If the first protective sheet 60 is adhered to the upper side of the opening 80, then the first protective sheet 60 extends downwards. If the first protective sheet 60 is adhered to the lower side of the opening 80, then the first protective sheet 60 extends upwards. A second adhesive portion 61 is provided at one end of the first protective sheet 60, which is adhered to the front film 10 by hot pressing. The first protective sheet 60 is adhered to the front film 10 by the second adhesive portion 61.

A patch 40 covering the first protective sheet 60 is adhered to an internal side of the opening 80, wherein the patch 40 is opposite to an adhering position of the first protective sheet 60. If the first protective sheet 60 is adhered to the upper side of the opening 80, then the patch 40 is adhered to the lower side of the opening 80, and vice versa.

Specifically, a first adhesion portion 41 is provided at one end of the patch 40, which is adhered to the front film 10 by hot pressing. The other end of the patch 40 is a movable end, and at least a pair of strip fasteners 50 are provided between the movable end of the patch 40 and the front film 10. By pressing the strip fasteners 50 firmly, the movable end of the patch 40 and the front film 10 are connected together.

During using, the tear strip 30 is torn off to form the opening 80, then the first protective sheet 60 is pulled out from the opening 80. The first protective sheet 60 can be held by one hand, and the front film 10 and the back film 20 near the opening 80 can be held by the other hand to separate the strip fasteners 50, thereby accessing the items in the child resistant through the opening 80, wherein the strip fasteners 50 comprise a male fastener 51 and a female fastener 52, and the male fastener 51 can be inserted into the female fastener 52 through deformation (this is prior art and will not be repeated herein).

The tear strip 30 can be adhered to the front film 10 by hot pressing, or can be set directly on the front film 10, which depends on actual needs.

The present invention also provides an easy-to-fill child resistant bag, as shown in FIGS. 6-21, wherein a connecting piece 70 is adhered to the internal side of the front film 10 of the bag body; the first protective sheet 60 is provided on the connecting piece 70, while the strip fasteners 50 are arranged between the patch 40 and the connecting piece 70.

Embodiment 1

Referring to FIGS. 6-9, in order to prevent children from easily opening the bag while ensuring easy open if used correctly, according to the embodiment 1, the tear strip 30 is provided on the internal face of the front film 10, wherein the tear strip 30 is adhered to the front film 10 by hot pressing. After removing the tear strip 30, a part of the front film 10, which is adhered to the tear strip 30, will also be torn off, so as to form the opening 80 on the front film 10.

Correspondingly, because the strip fasteners 50 can only be easily separated when pulled in the reverse direction from its clamping direction, in order to easily open the strip fasteners 50, the connecting piece 70 is adhered to the internal face of the front film 10 and located at the lower side of the opening 80 by hot pressing. An entire side face of the connecting piece 70 is adhered to the front film 10, so that the strip fasteners 50 can be placed between the connecting piece 70 and the patch 40, wherein the tear strip 30 is provided at an upper end of the connecting piece 70; a first adhesive portion 41 is provided at an upper end of the patch 40 and adhered to the upper side of the opening 80. Meanwhile, the first protective sheet 60 is adhered to the connecting piece 70, which also covers the tear strip 30. A second adhesive portion 61 is provided on the first protective sheet 60, which is adhered to the connecting piece 70 by hot pressing.

Figure 5:
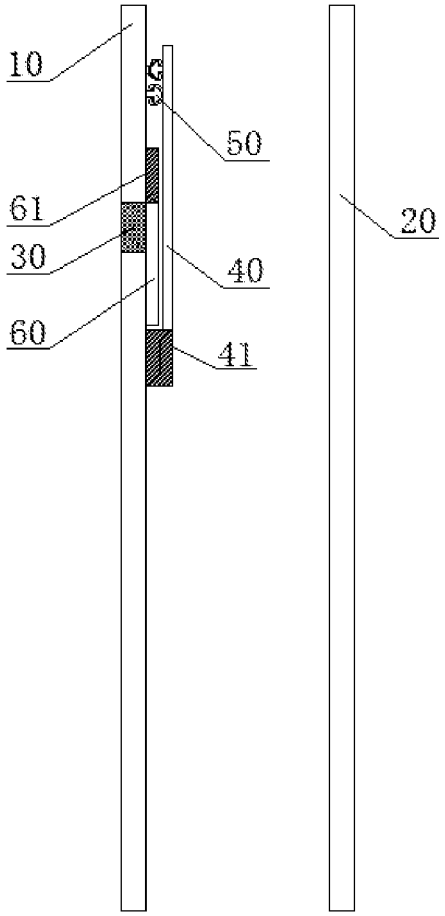
FIG. 5 is a sketch view of a fourth structure without the connecting piece.
Figure 6:
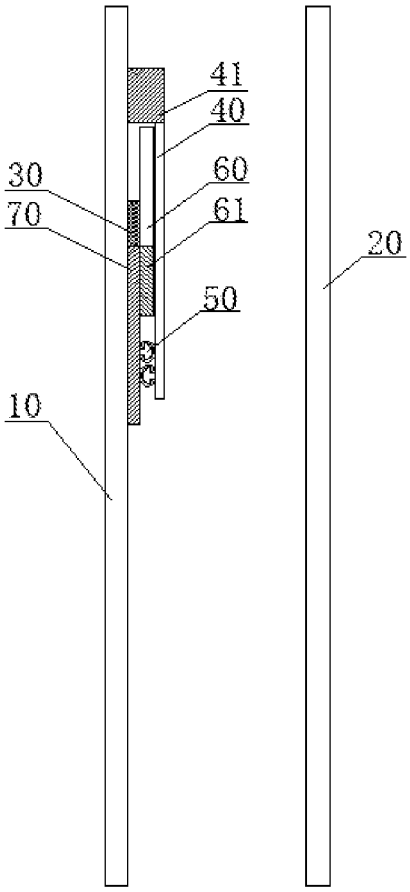
FIG. 6 is a structural view of an embodiment 1 having the connecting piece.
Figure 7:
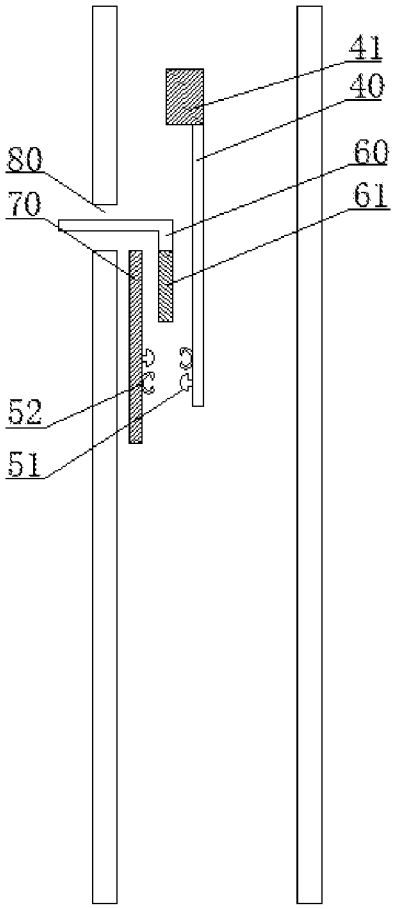
FIG. 7 illustrates a state of use of the embodiment 1 having the connecting piece.

Referring to FIG. 5, when it is necessary to pull, the first protective sheet 60 is pulled out from the opening 80, then the first protective sheet 60 is held by one hand, and the front film 10 and the back film 20 at the upper part of the opening 80 are held by the other hand to separate the strip fasteners 50 easily with both hands.

Accordingly, when the user is pulling, the male fastener 51 moves out of the female fastener 52, thereby separating the connecting piece 70 from the movable end of the patch 40 and accessing to the items in the bag.

If the first protective sheet 60 is not pulled out from the opening 80, at this time, when the front film 10 and the back film 20 near the opening 80 are held by one hand, the first protective sheet 60 will also be held. The other hand does not contact the strip fasteners 50, and there is no force applied on two sides of the strip fasteners 50. At this time, it is not possible to separate strip fasteners 50. Generally, children, due to the immaturity of their consciousness and action, will not pull the first protective sheet 60 out from the opening 80. Therefore, it is unable to open the strip fasteners 50, thus preventing children from opening. When necessary, the strip fasteners 50 can be tighten by pressing them from an external face of the front film 10.

At the same time, since the male fastener 51 and the female fastener 52 of the strip fasteners 50 are both covered by the patch 40 on the front film 10, internal faces of the front film 10 and the back film 20 are rounded and smooth when the upper part of the child resistant bag is opened during filling, which will not cause interference with the object, and is very easy to send items into the bag, so as to improve the filling efficiency. For liquid substances, since the strip fasteners 50 are covered by the patch 40, the liquid substances will not contact the strip fasteners 50 during filling, so that the strip fasteners 50 can be used normally. Conventionally, the male fastener 51 and the female fastener 52 of the strip fasteners 50 are arranged at two ends of the opening, so the liquid substance will easily adhere to the female fastener 52, which prevents the strip fasteners 50 from tightly fastening, affecting utilization thereof.

Figure 8:
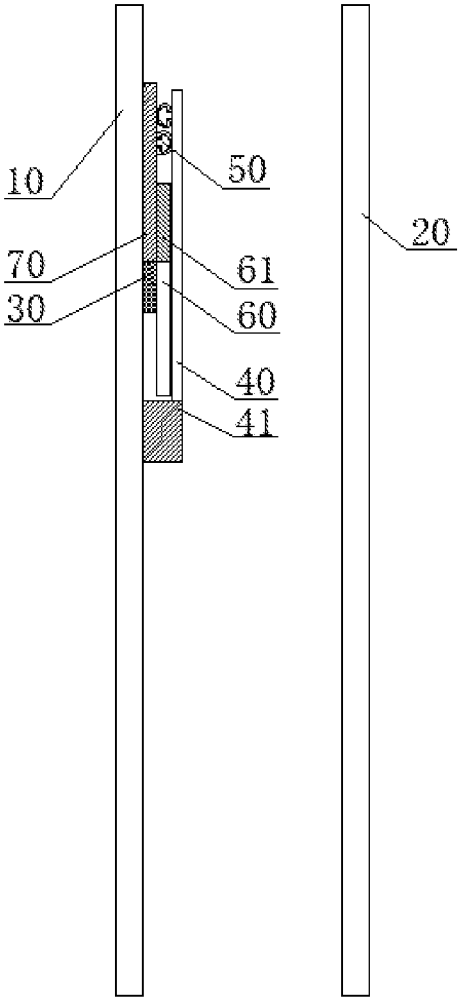
FIG. 8 illustrates an alternative structure of the embodiment 1 having the connecting piece.
Figure 9:
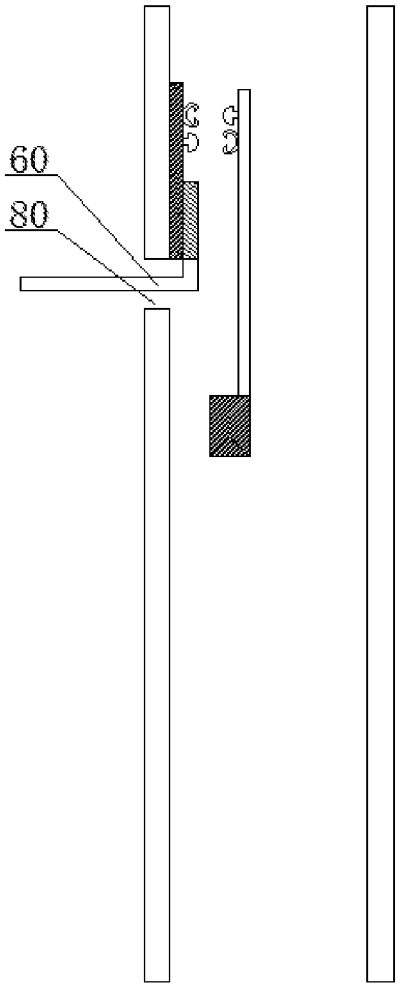
FIG. 9 illustrates a state of use of the alternative structure of the embodiment 1 having the connecting piece.
Figure 10:
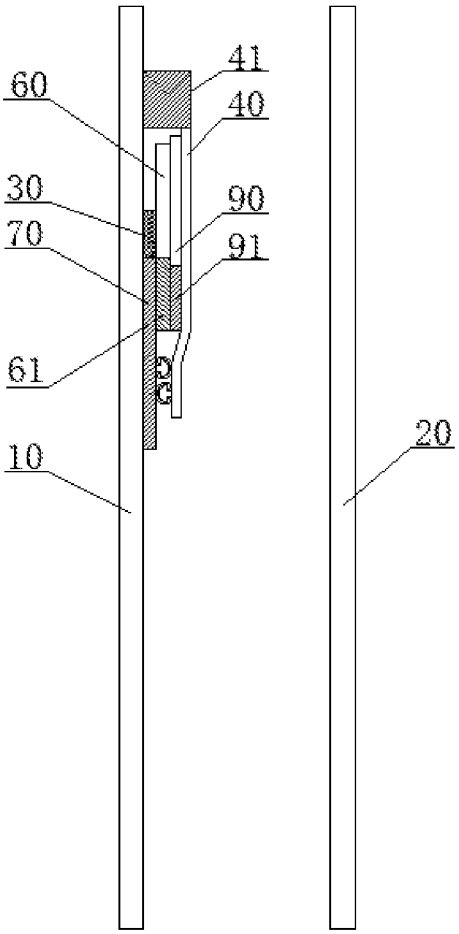
FIG. 10 is a structural view of an embodiment 2 having the connecting piece.
Figure 11:
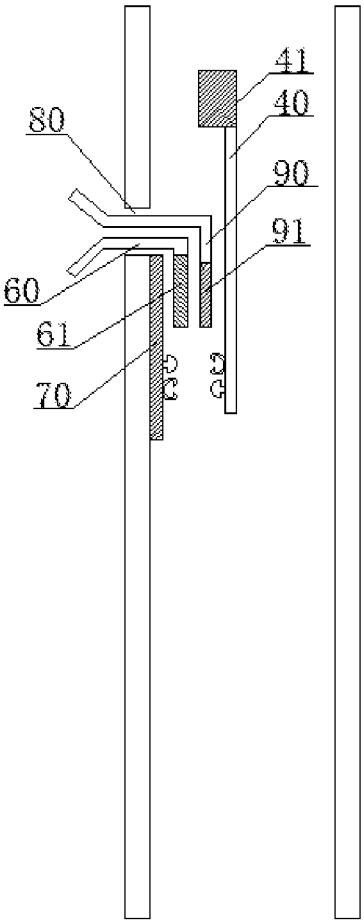
FIG. 11 illustrates a state of use of the embodiment 2 having the connecting piece.

Similarly, in the embodiment 1, the above adhering position can be turned up and down relative to the opening 80, which can also provide the child resistant function. Specifically, referring to FIGS. 8-9, the connecting piece 70 is adhered to the upper side of the opening 80, wherein the first protective sheet 60 is adhered to the connecting piece 70. The tear strip 30 is provided at the lower end of the connecting piece 70, while the lower end of the patch 40 is adhered to the front film 10. The strip fasteners 50 are placed between the upper end of the corresponding patch 40 and the connecting piece 70, and utilization of the bag is shown in FIG. 8, wherein the tear strip 30 is torn off, and the first protective sheet 60 is pulled out from the opening 80; at this time, the front film 10 and the back film 20 at the lower part of the opening 80 are held by one hand, and the first protective sheet 60 is held by the other hand, so as to separate the strip fasteners 50 by pulling from both sides. To take out the items in the bag body, it is necessary to bypass the patch 40 from the upper side of the opening 80 before accessing to the items in the bag, which improves the child resistant function.

Embodiment 2

If the child resistant bag is full of items, the front film 10 and the back film 20 are then puffed, and it is less convenient to separate the strip fasteners 50 when holding the front film 10 and the back film 20 by one hand. According to the embodiment 2, as shown in FIGS. 10-13, the tear strip 30 is adhered to the front film 10 by hot pressing, and the connecting piece 70 is adhered to the internal face of the front film 10 by hot pressing and is located below the opening 80. The tear strip 30 is placed at the upper end of the connecting piece 70, the upper end of the patch 40 is adhered to the front film 10, and the lower end of the connecting piece 70 is still connected to the lower end of the patch 40 by the strip fasteners 50, wherein a second protective sheet 90 is provided between the first protective sheet 60 and the patch 40. A third adhesive portion 91 is provided at a lower end of the second protective sheet 90, which is adhered to the patch 40 by hot pressing. That is to say, the first protective sheet 90 is adhered to the connecting piece 70 and the second protective sheet 90 is adhered to the patch 40, wherein the upper end of the second protective sheet 91 is a movable end.

Specifically, in the embodiment 2, when the strip 30 is torn off, the opening 80 is formed on the front film 10, and the first protective sheet 60 and the movable end of the second protective sheet 90 are pulled out the opening 80. At this time, the first protective sheet 60 is held by one hand, and the second protective sheet 90 is held by the other hand, wherein pulling forces of both hands are applied at both sides of the strip fasteners 50, thereby separate the strip fasteners 50. When necessary, the strip fasteners 50 can be tighten by pressing them from the external face of the front film 10.

Specifically, as the items in the child resistant bag are getting fewer and fewer, there will be no need to get the second protective sheet 90 out of the opening 80. At this point, it is possible to just hold the front film 10 and the back film 20, because when you hold both the front film 10 and the back film 20, you will hold the second protective sheet 90 as well.

Figure 12:
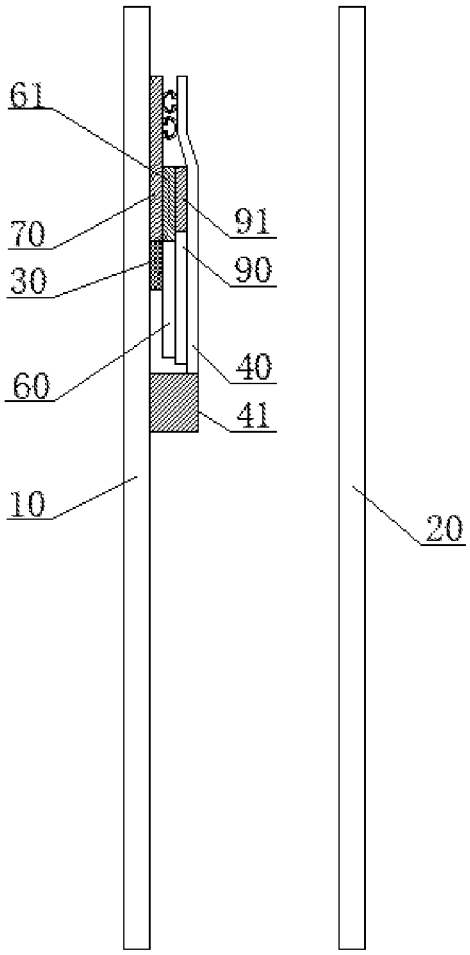
FIG. 12 illustrates an alternative structure of the embodiment 2 having the connecting piece.
Figure 13:
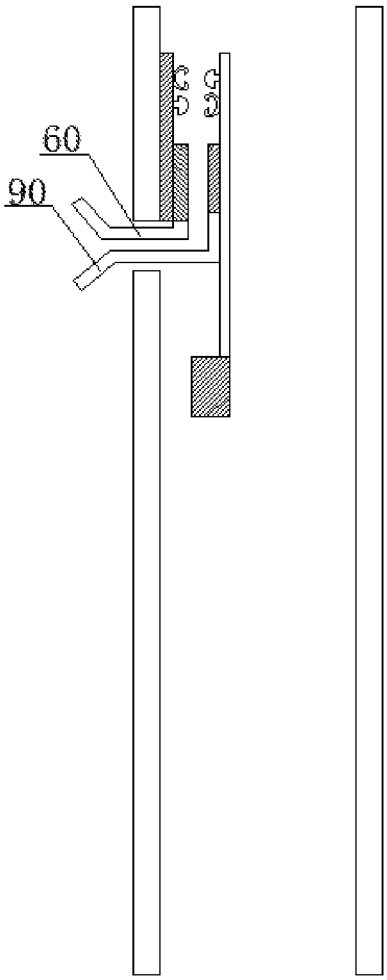
FIG. 13 illustrates a state of use of the alternative structure of the embodiment 2 having the connecting piece.
Figure 14:
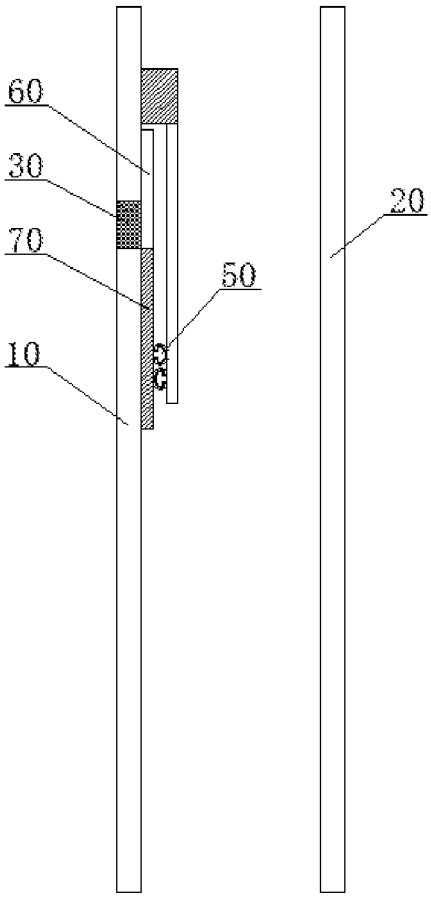
FIG. 14 is a structural view of an embodiment 3 having the connecting piece.
Figure 15:
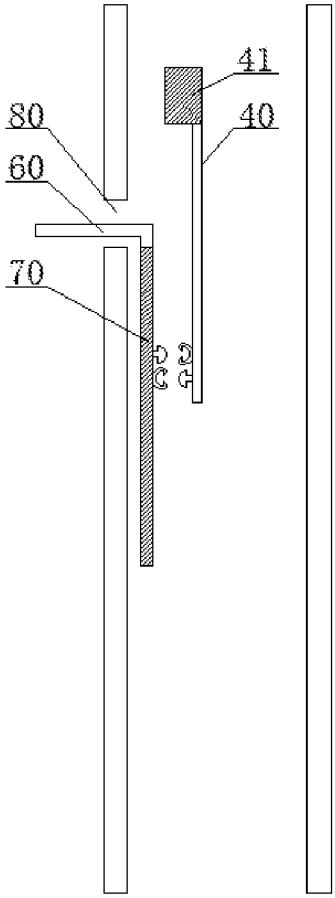
FIG. 15 illustrates a state of use of the embodiment 3 having the connecting piece.

Similarly, in the embodiment 2, the adhering positions of each component can be turned up and down around the opening 80 without losing the child resistant function. Referring to FIGS. 12-13, the connecting piece 70 is adhered to the upper side of the opening 80, the tear strip 20 is provided at the lower end of the connecting piece 70, the lower end of the patch 40 is adhered to the front film 10, and the upper end of the patch 40 is connected to the connecting piece 70 through the strip fasteners 50. Correspondingly, the second protective sheet 91 adhered to the patch 40 is placed at the upper side of the opening 80, as shown in FIG. 15. At this time, to take out the items in the bag body, it is necessary to bypass the patch 40 from the upper side of the opening 80 before accessing to the items in the bag, which is more difficult for children to reach the items and improves the child resistant function.

Embodiment 3

Specifically, in order to simplify the structure and processing, in the embodiment 3 as shown in FIGS. 14-17, the front film 10 is directly provided with tear strip 30, which means the tear strip 30 is directly mounted on the front film 10. The tear strip 30 is easy to tear off, and when the tear strip 30 is torn off, the opening 80 will be exposed. The connecting piece 70 is adhered to the internal face of the front film 10 by hot pressing and is located at the lower side of the opening 80, wherein the strip fasteners 50 are arranged between the connecting piece 70 and the patch 40. The upper end of the patch 40 is adhered to the upper side of the opening 80, and the strip fasteners 50 are provided at the lower side of the opening 80.

Specifically, a first protective sheet 60 is integrally molded at the upper end of the connecting piece 70, and the first protective sheet 60 covers the tear strip 30. When the opening 80 is exposed, the first protective sheet 60 can be pulled out of the opening 80, then the first protective sheet 60 is held by one hand and the front film 10 and the back film 20 are held by the other hand to separating the strip fasteners 50 by pulling with both hands, thereby accessing to the items in the bag.

Figure 16:
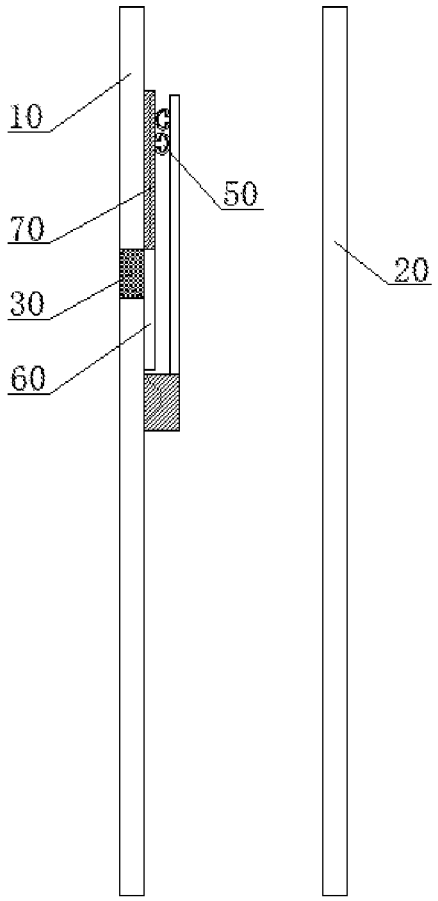
FIG. 16 illustrates an alternative structure of the embodiment 3 having the connecting piece.
Figure 17:
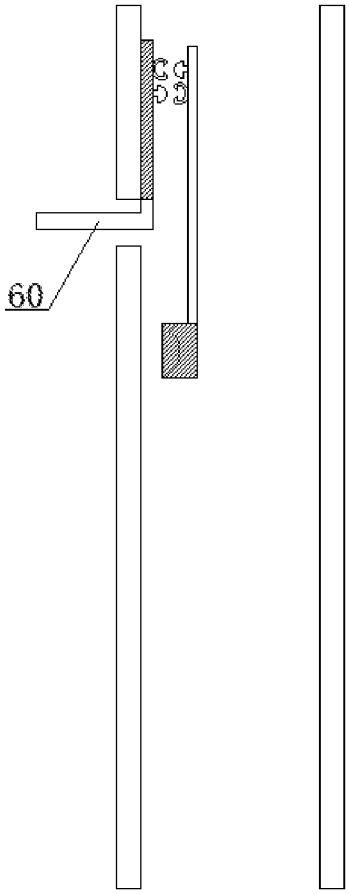
FIG. 17 illustrates a state of use of the alternative structure of the embodiment 3 having the connecting piece.
Figure 18:
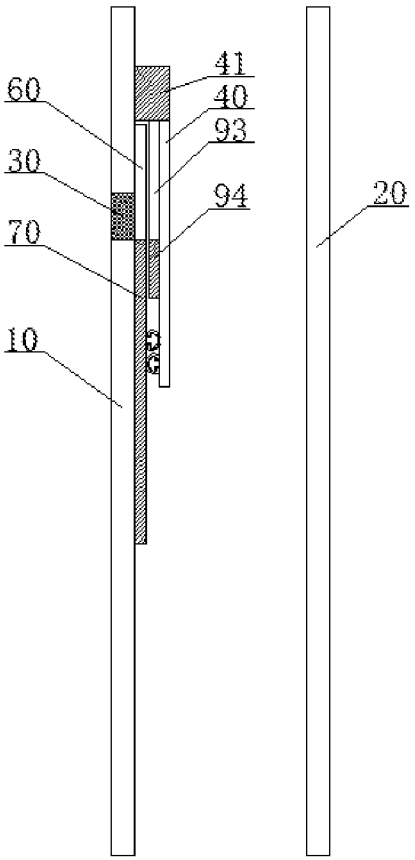
FIG. 18 is a structural view of an embodiment 4 having the connecting piece.
Figure 19:
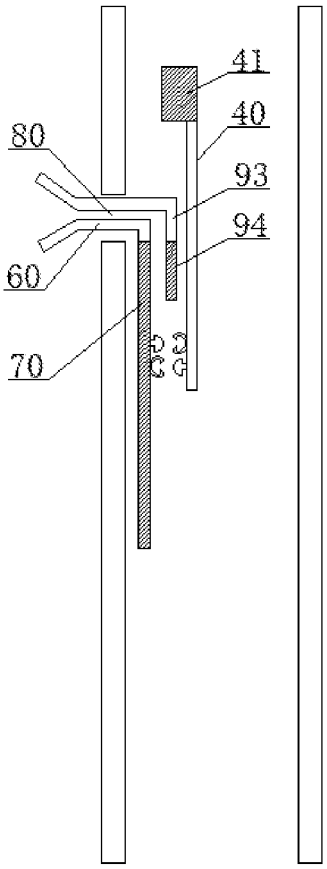
FIG. 19 illustrates a state of use of the embodiment 4 having the connecting piece.
Figure 20:
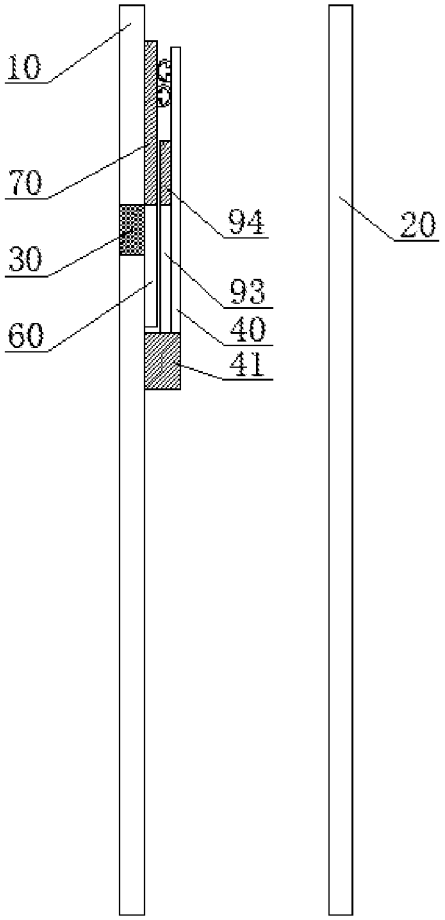
FIG. 20 illustrates an alternative structure of the embodiment 4 having the connecting piece.
Figure 21:
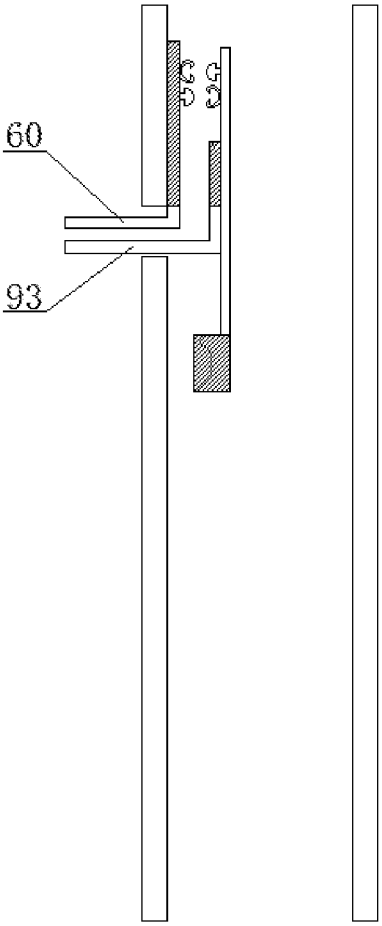
FIG. 21 illustrates a state of use of the alternative structure of the embodiment 4 having the connecting piece.

Similarly, in the embodiment 3, as shown in FIGS. 16-17, adhering positions of the connecting piece 70 and the patch 40 can be turned up and down around the opening 80 without losing the child resistant function. Specifically, the connecting piece 70 is adhered to the upper part of the internal face of the opening 80, while the tear strip 30 is set at the lower end of the connecting piece 70. The lower end of the patch 40 is adhered to the front film 10, and the strip fasteners 50 is set at the upper end of the patch 40 and is attached to the connecting piece 70. To take out the items, as shown in FIG. 21, the first protective sheet 21 is first pulled out from the opening 80 to separate the strip fasteners 50, then it is necessary to bypass the patch 40 from the upper side of the opening 80 before accessing to the items in the bag, which provides the child resistant function.

Embodiment 4

In the embodiment 3, if the child resistant bag is full of items, the front film 10 and the back film 20 are then puffed. As a result, it is inconvenient to hold the front film 10 and the back film 20 to separate the strip fasteners 50. To easily separate the strip fasteners 50, as shown in FIGS. 18-21, a bar-shaped opening 80 is arranged on the front film 10, which is covered with the tear strip 30. That is to say, the tear strip 30 is directly mounted on the front film 10, and the opening 80 will be exposed after removing tear strip 30.

Preferably, the connecting piece 70 is adhered to the lower side of the opening 80. The first protective sheet 60 is integrally molded at the upper end of the connecting piece 70. A third protective sheet 93 is provided between the connecting piece 70 and the patch 40. A fourth adhesive portion 94 is provided at a lower end of the third protective sheet 93, which is adhered to the patch 40 by hot pressing. An upper end of the third protective sheet 93 is a movable end. When separating the strip fasteners 50, the first protective sheet 60 and the movable end of the third protective sheet 93 are pulled out from the opening 80, then the first protective sheet 60 is held by one hand and the second protective sheet 93 is held by the other hand, so as to separate the strip fasteners 50 by pulling with both hands, thereby accessing to the items in the bag.

The above adhering positions can be turned up and down around the opening 80 without losing the child resistant function, which means the connecting piece 70 is adhered above the opening 80, the first protective sheet 60 is set below the connecting piece 70, the lower end of the patch 40 is adhered to the front film 10 and located on the lower side of the opening 80, and the upper end of the patch 40 is connected to the connecting piece 70 through the strip fasteners 50. Correspondingly, the fourth adhesive portion 94 is located at the upper end of the third protective sheet 93 and is adhered to the patch 40. During use, the first protective sheet 60 and the third protective sheet 93 are pulled out from the opening 80, and the strip fasteners 50 can be separated be pulling with both hands, then it is necessary to bypass the patch 40 from the upper side of the opening 80 before accessing to the items in the bag, which provides the child resistant function.

Specifically, to tear off the tear strip 30 in the above embodiments, a hand-held portion 31 is provided at one end of the tear strip 30, wherein the hand-held portion 31 is exposed through the side face of the front film 10, so that the user only needs to pinch the hand-held portion 31 to remove tear strip 30, thereby opening the opening 80.

There may be two pairs of the strip fasteners 50, wherein the two pairs of strip fasteners 50 are distributed up and down to ensure tight locking and sealing. The male fastener 51 of the upper pair of the strip fasteners 50 and the female fastener 52 of the lower pair of the strip fasteners 50 are located on the same side, and the female fastener 52 of the upper strip fasteners 50 and the male fastener 51 of the lower strip fasteners 50 are located on the other side.

It should be understood that the above description of the specific embodiments is only to illustrate the technical routes and features of the present invention, which is intended to enable the person skilled in the art to understand the content of the present invention, and thus implementing it. However, the present invention is not limited to the above specific embodiments. Any changes or modifications made within the scope defined by the following claims shall be covered within the protection scope of the present invention.

What is claimed is:

1. An easy-to-fill child resistant bag, comprising: a bag body formed by a front film (10) and a back film (20), wherein edges of the front film (10) are adhered to edges of the back film (20); a tear strip (30) is provided on the front film (10) and configured to form an opening (80) on the front film (10); a sealing device with a child resistant function is provided on an internal face of the bag body corresponding to the opening (80), and the sealing device comprises a connecting piece (70) adhering to an upper side or a lower side of the opening (80), and a patch (40) adhering to a side opposite to an adhering position of the connecting piece (70); at least one pair of strip fasteners (50) is provided between the patch (40) and the connecting piece (70); a first protective sheet (60) is provided on the connecting piece (70), and the first protective sheet (60) covers the opening (80) and extends to an adhering position of the patch (40);

wherein a second protective sheet (90) is adhered to the patch (40), and the second protective sheet (90) is adhered near the strip fasteners (50).

* * * * *